US005925986A

United States Patent [19]

Moisin

[11] Patent Number: 5,925,986

[45] Date of Patent: Jul. 20, 1999

[54] METHOD AND APPARATUS FOR CONTROLLING POWER DELIVERED TO A FLUORESCENT LAMP

[75] Inventor: Mihail Moisin, Lake Forest, Ill.

[73] Assignee: Pacific Scientific Company, Washington, D.C.

[21] Appl. No.: 08/647,030

[22] Filed: May 9, 1996

[51] Int. Cl.[6] ..... G05F 1/70

[52] U.S. Cl. ..... 315/247; 315/225; 315/205; 315/209 R; 315/DIG. 5; 323/207

[58] Field of Search ..... 315/307, DIG. 7, 315/225, 247, 289, 219, 283, 284, 291, 205, 209 R, DIG. 5; 323/207; 363/37, 89

[56] References Cited

U.S. PATENT DOCUMENTS

| | | | |
|---|---|---|---|
| 2,505,112 | 7/1950 | Hallman . | |
| 2,966,602 | 12/1960 | Waymouth et al. | 313/44 |
| 3,112,890 | 12/1963 | Snelling . | |
| 3,517,259 | 6/1970 | Dotto | 315/200 |
| 3,569,817 | 3/1971 | Boehringer | 323/18 X |
| 3,611,021 | 10/1971 | Wallace | 315/239 |
| 3,736,496 | 5/1973 | Lachocki | 323/25 X |
| 3,882,356 | 5/1975 | Stehlin | 315/205 |
| 3,913,000 | 10/1975 | Cardwell, Jr. | 323/17 X |
| 3,965,345 | 6/1976 | Fordsmand | 240/47 |
| 3,974,418 | 8/1976 | Fridrich | 315/59 |
| 4,005,334 | 1/1977 | Andrews | 315/208 |
| 4,016,451 | 4/1977 | Engel | 315/158 |
| 4,053,813 | 10/1977 | Kornrumpf et al. | 315/206 |
| 4,125,767 | 11/1978 | Silver | 250/214 D |
| 4,127,795 | 11/1978 | Knoll | 315/210 |
| 4,127,798 | 11/1978 | Anderson | 315/209 R |
| 4,135,116 | 1/1979 | Smith | 315/158 |
| 4,160,288 | 7/1979 | Stuart et al. | 363/41 |
| 4,168,453 | 9/1979 | Gerhard et al. | 315/225 |
| 4,230,971 | 10/1980 | Gerhard et al. | 315/307 |
| 4,237,403 | 12/1980 | Davis | 315/98 |
| 4,245,285 | 1/1981 | Weiss | 363/17 |

(List continued on next page.)

FOREIGN PATENT DOCUMENTS

| | | |
|---|---|---|
| 0114370 | 8/1984 | European Pat. Off. . |
| 0127101 | 12/1984 | European Pat. Off. . |
| 0239863 | 10/1987 | European Pat. Off. . |
| 0395776 | 11/1990 | European Pat. Off. . |
| 0441253 | 8/1991 | European Pat. Off. . |
| 3437554 | 4/1986 | Germany . |
| 0259646 | 3/1988 | Germany . |
| 3632272 | 4/1988 | Germany . |
| 3813672 | 11/1988 | Germany . |
| 655042 | 12/1976 | U.S.S.R. . |
| 9000830 | 1/1990 | WIPO . |
| 9009729 | 8/1990 | WIPO . |
| 9309649 | 5/1993 | WIPO . |
| 94/27420 | 11/1994 | WIPO . |

OTHER PUBLICATIONS

Kröning, et al., "New Electronic Control Gear," *Siemens Power Engineering & Automation VII,* No. 2, pp. 102–104 1985.

Hayt, et al., *Engineering Circuit Analysis,* 3 ed., pp. 296–297, 1978, McGraw–Hill Book Co.

Osram Delux® compact fluorescent lamps, "Economical long–life lighting—with extra convenience of electronic control gear", pp. 1–15, Jul. 1993.

Philips Lighting, "Lamp specification and application guide", pp. 1, 11, 61–64, 78, May 1993.

*Primary Examiner*—Arnold Kinkead
*Attorney, Agent, or Firm*—Knobbe, Martens, Olson & Bear, LLP

[57] ABSTRACT

An improved ballast circuit for controlling the power delivered to a fluorescent lamp. The present invention uses a complex resonating circuit to dynamically adjust the power being delivered to the load. The present invention also operates in burst mode allowing an increased voltage to be applied across the lamp load without overstressing the circuit. The increased voltage will light both lamps nearing the end-of-life and lamps in cold weather.

11 Claims, 4 Drawing Sheets

U.S. PATENT DOCUMENTS

| | | | |
|---|---|---|---|
| 4,284,925 | 8/1981 | Bessone et al. | 315/240 |
| 4,348,615 | 9/1982 | Garrison et al. | 315/219 |
| 4,350,891 | 9/1982 | Wuerflein | 315/308 |
| 4,353,009 | 10/1982 | Knoll | 315/220 |
| 4,370,600 | 1/1983 | Zansky | 315/244 |
| 4,379,254 | 4/1983 | Hurban | 315/291 |
| 4,388,563 | 6/1983 | Hyltin | 315/205 |
| 4,392,087 | 7/1983 | Zansky | 315/219 |
| 4,393,323 | 7/1983 | Hubner | 313/110 |
| 4,395,660 | 7/1983 | Waszkiewicz | 315/291 |
| 4,399,391 | 8/1983 | Hammer et al. | 315/244 |
| 4,423,348 | 12/1983 | Greiler | 313/113 |
| 4,443,740 | 4/1984 | Goralnik | 315/284 |
| 4,481,460 | 11/1984 | Kröning et al. | 323/266 |
| 4,510,400 | 4/1985 | Kiteley | 323/222 X |
| 4,523,131 | 6/1985 | Zansky | 315/307 |
| 4,533,986 | 8/1985 | Jones | 363/17 |
| 4,544,863 | 10/1985 | Hashimoto | 315/209 R |
| 4,547,706 | 10/1985 | Krummel | 315/226 |
| 4,562,383 | 12/1985 | Kerschner et al. | 315/225 |
| 4,580,080 | 4/1986 | Smith | 315/199 |
| 4,612,479 | 9/1986 | Zansky | 315/194 |
| 4,613,934 | 9/1986 | Pacholok | 363/131 |
| 4,616,158 | 10/1986 | Krummel et al. | 315/225 |
| 4,620,271 | 10/1986 | Musil | 363/21 |
| 4,626,746 | 12/1986 | Zaderej | 315/208 |
| 4,631,450 | 12/1986 | Lagree et al. | 315/244 |
| 4,641,061 | 2/1987 | Munson | 315/210 |
| 4,647,817 | 3/1987 | Fähnrich et al. | 315/104 |
| 4,651,060 | 3/1987 | Clark | 315/199 |
| 4,677,345 | 6/1987 | Nilssen | 315/209 R |
| 4,682,083 | 7/1987 | Alley | 315/307 |
| 4,683,402 | 7/1987 | Aubrey | 315/56 |
| 4,700,113 | 10/1987 | Stupp et al. | 315/224 |
| 4,730,147 | 3/1988 | Kroening | 315/100 |
| 4,739,227 | 4/1988 | Anderson | 315/260 |
| 4,742,535 | 5/1988 | Hino et al. | 363/17 X |
| 4,743,835 | 5/1988 | Bossé et al. | 323/266 |
| 4,857,806 | 8/1989 | Nilssen | 315/72 |
| 4,859,914 | 8/1989 | Summa | 315/354 |
| 4,864,482 | 9/1989 | Quazi et al. | 363/37 |
| 4,894,587 | 1/1990 | Jungreis et al. | 315/200 R |
| 4,933,605 | 6/1990 | Quazi et al. | 315/224 |
| 4,943,886 | 7/1990 | Quazi | 361/42 |
| 4,949,020 | 8/1990 | Warren et al. | 315/297 |
| 4,950,963 | 8/1990 | Sievers | 315/36 |
| 4,954,768 | 9/1990 | Luchaco et al. | 323/300 |
| 4,988,921 | 1/1991 | Ratner et al. | 315/159 |
| 4,996,462 | 2/1991 | Krummel | 315/209 R |
| 4,999,547 | 3/1991 | Ottenstein | 315/307 |
| 5,001,386 | 3/1991 | Sullivan et al. | 315/219 |
| 5,003,230 | 3/1991 | Wong et al. | 315/279 |
| 5,004,959 | 4/1991 | Nilssen | 315/291 |
| 5,004,972 | 4/1991 | Roth | 323/320 |
| 5,039,914 | 8/1991 | Szuba | 315/158 |
| 5,041,763 | 8/1991 | Sullivan et al. | 315/176 |
| 5,083,081 | 1/1992 | Barrault et al. | 324/126 |
| 5,084,653 | 1/1992 | Nilssen | 315/219 |
| 5,089,751 | 2/1992 | Wong et al. | 315/279 |
| 5,097,181 | 3/1992 | Kakitani | 315/209 R |
| 5,172,033 | 12/1992 | Smits | 315/224 |
| 5,172,034 | 12/1992 | Brinkerhoff | 315/307 |
| 5,173,643 | 12/1992 | Sullivan et al. | 315/276 |
| 5,174,646 | 12/1992 | Siminovitch et al. | 362/218 |
| 5,175,477 | 12/1992 | Grissom | 315/291 |
| 5,185,560 | 2/1993 | Nilssen | 315/219 |
| 5,192,896 | 3/1993 | Qin | 315/224 |
| 5,194,782 | 3/1993 | Richardson et al. | 315/291 |
| 5,198,726 | 3/1993 | Van Meurs et al. | 315/224 |
| 5,214,356 | 5/1993 | Nilssen | 315/224 |
| 5,233,270 | 8/1993 | Nilssen | 315/58 |
| 5,237,243 | 8/1993 | Chung | 315/219 |
| 5,245,253 | 9/1993 | Quazi | 315/224 |
| 5,289,079 | 2/1994 | Wittman | 313/318 |
| 5,289,083 | 2/1994 | Quazi | 315/224 |
| 5,296,783 | 3/1994 | Fischer | 315/64 |
| 5,309,062 | 5/1994 | Perkins et al. | 315/53 |
| 5,313,142 | 5/1994 | Wong | 315/205 |
| 5,319,284 | 6/1994 | Lee | 315/209 R |
| 5,321,337 | 6/1994 | Hsu | 315/219 |
| 5,331,253 | 7/1994 | Counts | 315/209 R |
| 5,341,067 | 8/1994 | Nilssen | 315/209 R |
| 5,394,064 | 2/1995 | Ranganath et al. | 315/209 R |
| 5,396,154 | 3/1995 | Shiy et al. | 315/291 |
| 5,396,155 | 3/1995 | Bezdon et al. | 315/291 |
| 5,404,082 | 4/1995 | Hernandez et al. | 315/219 |
| 5,495,149 | 2/1996 | Hiramatsu et al. | 315/209 R |
| 5,550,438 | 8/1996 | Reijnaerts | 315/219 |
| 5,568,041 | 10/1996 | Hesterman | 323/207 |
| 5,650,694 | 7/1997 | Jayaraman et al. | 315/225 |

| FIG. 2A | FIG. 2B | FIG. 2C |
|---|---|---|

METHOD AND APPARATUS FOR CONTROLLING POWER DELIVERED TO A FLUORESCENT LAMP

BACKGROUND OF THE INVENTION

1. Field of the Invention

The present invention relates to improved apparatus and methods for operating fluorescent lamps and, in particular, to a method and apparatus to control the power delivered to a fluorescent lamp.

2. Description of the Prior Art

Fluorescent lamps are conventional types of lighting devices. They are gas charged devices which provide illumination as a result of atomic excitation of a low-pressure gas, such as mercury, within a lamp envelope. The excitation of the mercury vapor atoms is provided by a pair of heater filament elements mounted within the lamp at opposite ends of the lamp envelope. In order to properly excite the mercury vapor atoms, the lamp is ignited or struck by a higher than normal voltage. Upon ignition of the lamp, the impedance decreases and the voltage across the lamp drops to the operating level at a relatively constant current. The excited mercury vapor atoms emit invisible ultraviolet radiation which in turn excites a fluorescent material, e.g., phosphor, that is deposited on an inside surface of the fluorescent lamp envelope, thus converting the invisible ultraviolet radiation to visible light. The fluorescent coating material is selected to emit visible radiation over a wide spectrum of colors and intensities.

As is known to those skilled in the art, a ballast circuit is commonly disposed in electrical communication with the lamp to provide the elevated voltage levels and the constant current required for fluorescent illumination. Typical ballast circuits electrically connect the fluorescent lamp to line alternating current and convert this alternating current provided by the power transmission lines to the constant current and voltage levels required by the lamp.

Fluorescent lamps have substantial advantages over conventional incandescent lamps. In particular, the fluorescent lamps are substantially more efficient and typically use 80 to 90% less electrical power than incandescent lamps for an equivalent light output. For this reason, fluorescent lamps have gained use in a wide range of power sensitive applications.

To strike, or light, a fluorescent lamp a high voltage level is required rather than high power. To achieve this high voltage, many current fluorescent lamp ballast designs dissipate high power levels Additionally, at the end of a lamps life-cycle, the voltage required to strike the lamp increases due to the depletion of the electron emitting coating on the filament heater element. This results in the lamp not lighting because the peak voltage required to strike the lamp cannot be provided by conventional ballasts. Also, low temperatures require a higher voltage to strike the lamp. This is due to the greater thermal gradient between the environmental temperature and that necessary to ignite the lamp. This limits the environmental operating range of current ballast designs, making them unusable at low wintertime temperatures.

In addition present ballasts are limited in their ability to accommodate a range of tube lengths. This being the case, the circuit is normally tuned to the specific lamp load. Many designs require that when lamps are hot changed, i.e., circuit power is not turned off, that the circuit be reset.

SUMMARY OF THE INVENTION

The present invention provides a number of improvements in electronic fluorescent ballast apparatus and electronic ballasts constructed in accordance with the preferred embodiment of the invention enabling improved control over the power delivered to a series connected fluorescent lamp load. A feature of one of the preferred embodiments is that the ballast circuit is automatically responsive to a variable input AC power source so that the ballasts may be utilized over a wide range of line input voltages. The invention further dynamically extends the current sense range of the power factor controller.

Another feature of the invention is that it automatically adjusts for differing flourescent lamp lengths.

Further, as noted above, the prior art has failed to solve the problems present at the end of a fluorescent lamp life cycle and in cold weather starting. The present invention features both an extended life of the fluorescent bulb and improved cold starting ability.

In the principal embodiment of the present invention, a fluorescent lamp ballast provides a high frequency high voltage to strike one or more lamps connected in series. The ballast includes a rectification stage for rectifying the AC input voltage, a power factor control stage for improving the electrical efficiency, and an amplification, AC conversion, and series resonant lamp drive stage.

The present invention also includes a method of controlling the power transferred to a lamp load in a fluorescent ballast. The method comprises the steps of receiving an AC input voltage, converting the AC to DC, converting the DC to high frequency high voltage AC and applying the input voltage across a lamp. The method further comprises the steps of striking the lamp at a predetermined elevated voltage level and reducing the inductance in the ballast after striking the lamp. Additionally the method provides a means of continually providing sequences of high voltage oscillation to lamps which fail to strike but have intact filament heaters. The circuit also will not operate when the heater filaments are not intact thereby providing a safety factor.

DETAILED DESCRIPTION OF THE PREFERRED EMBODIMENT

Figure 1:
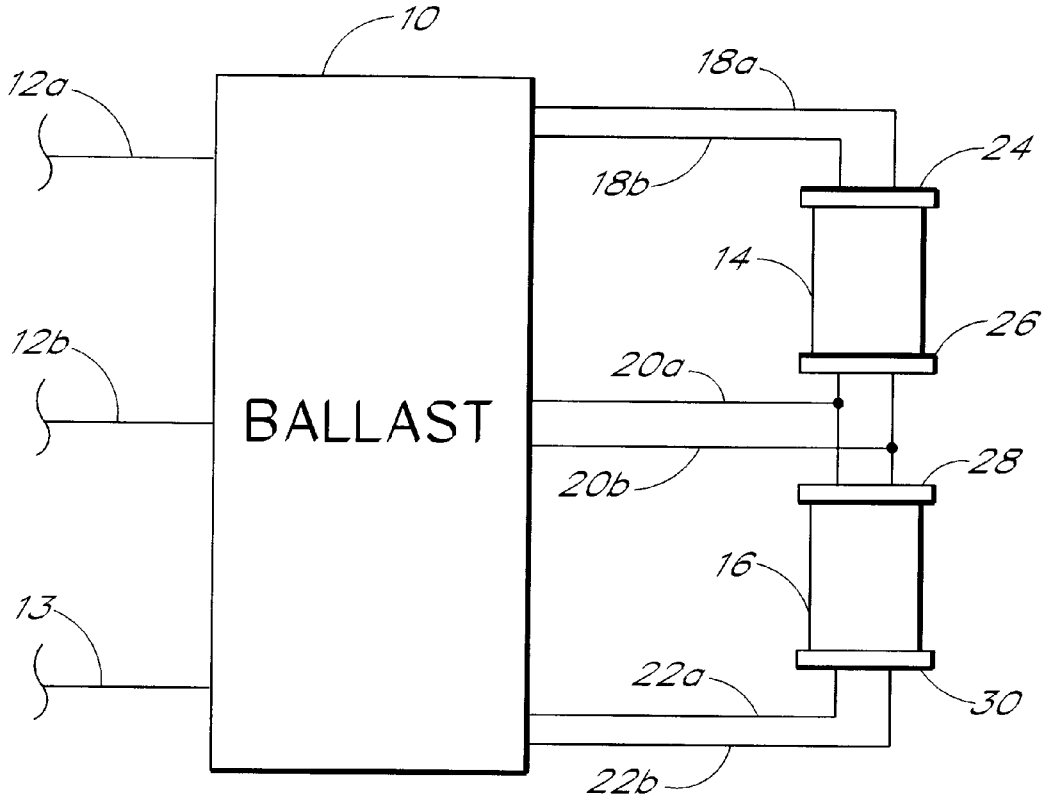
FIG. 1 is a pictorial representation of a fluorescent lamp system which incorporates the present invention.

FIG. 1 illustrates an exemplary fluorescent lamp system including first and second input power lines 12*a*, 12*b*, a ballast circuit 10, lamp power lines 18*a*, 18*b*, 22*a* and, 22*b*, lamp connectors 24, 26, 28 and 30, lamp interconnect power lines 20*a* and 20*b*, and lamps 14 and 16. The ballast circuit 10 is also connected to a safety ground line 13. The ballast circuit 10 receives an AC voltage via the input power lines 12*a*, 12*b* and 13. The ballast circuit 10 converts the AC voltage into a DC voltage and supplies a regulated high frequency AC voltage to the lamp power lines 18*a*, 18*b*, 20*a*, 20*b*, 22*a* and 22*b*. The first lamp 14 is connected between the lamp connector 24 and the lamp connector 26. The second lamp 16 is connected between the lamp connector 28 and the lamp connector 30. The lamp power lines 18*a*, 18*b* and 20*a*, 20*b* connect the ballast circuit 10 to lamp connectors 24 and 26. The lamp power lines 20*a*, 20*b* and 22*a*, 22*b* connect the ballast circuit 10 to lamp connectors 28 and 30. The lamp connector 26 is connected in series to the lamp connector 28 by the interconnect power lines 21*a* and 21*b*. Input power is provided to the lamp series by ballast originated power lines 18*a*, 18*b*, 22*a* and 22*b*.

Figures 2, 2A:
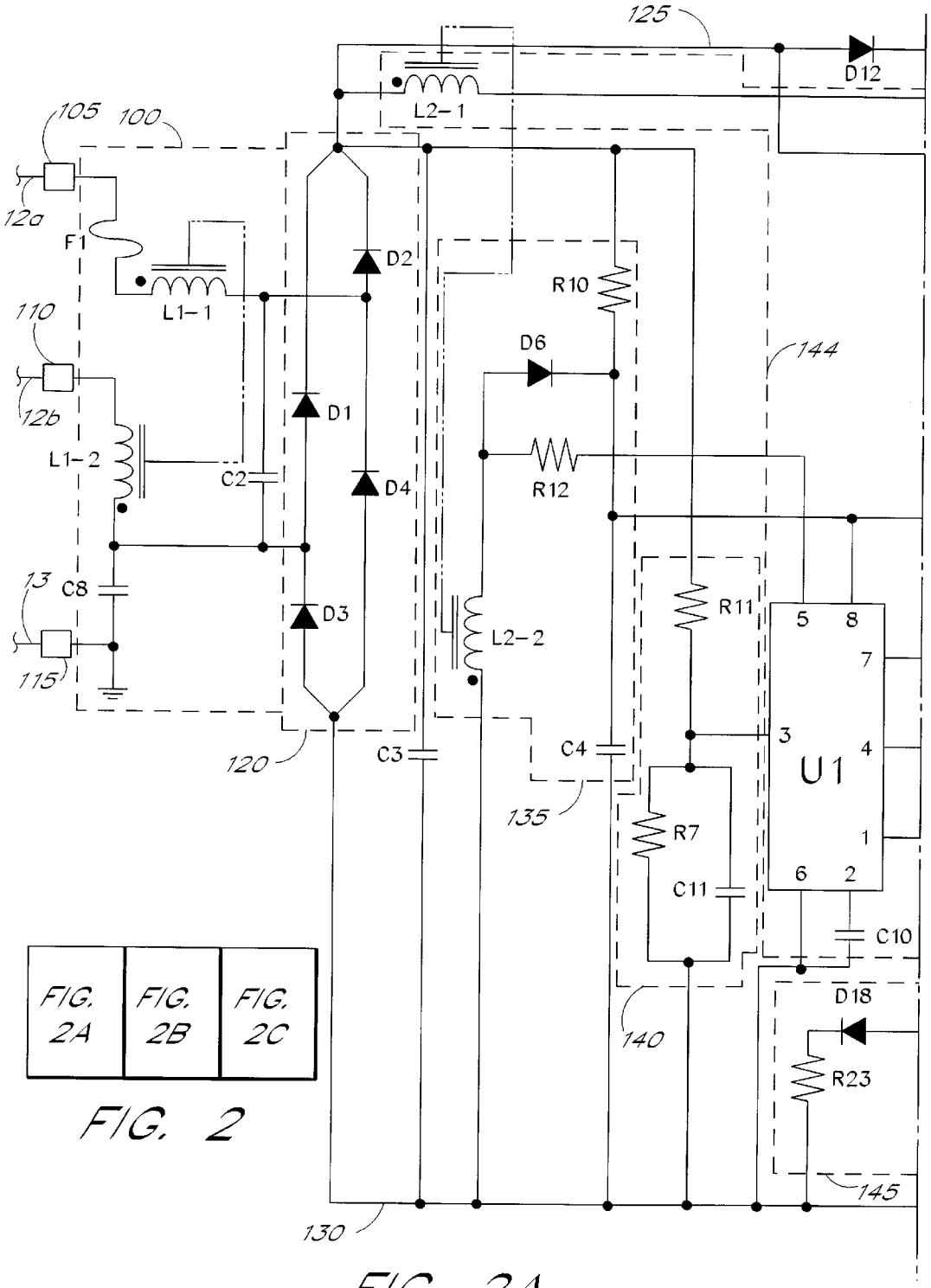
FIGS. 2A–2C is a schematic circuit diagram of a ballast circuit of the present invention.
Figure 2B:
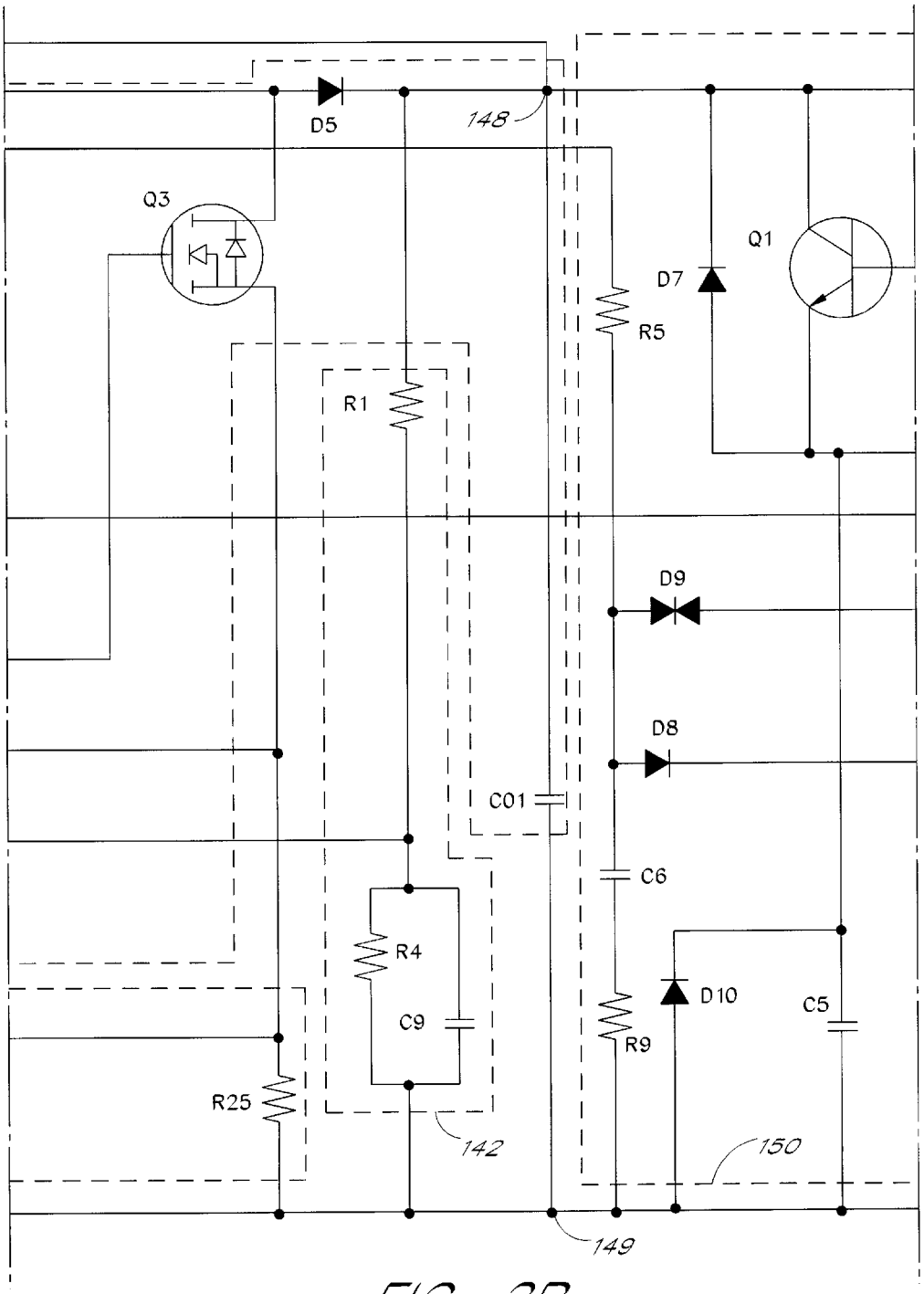
Figure 2C:
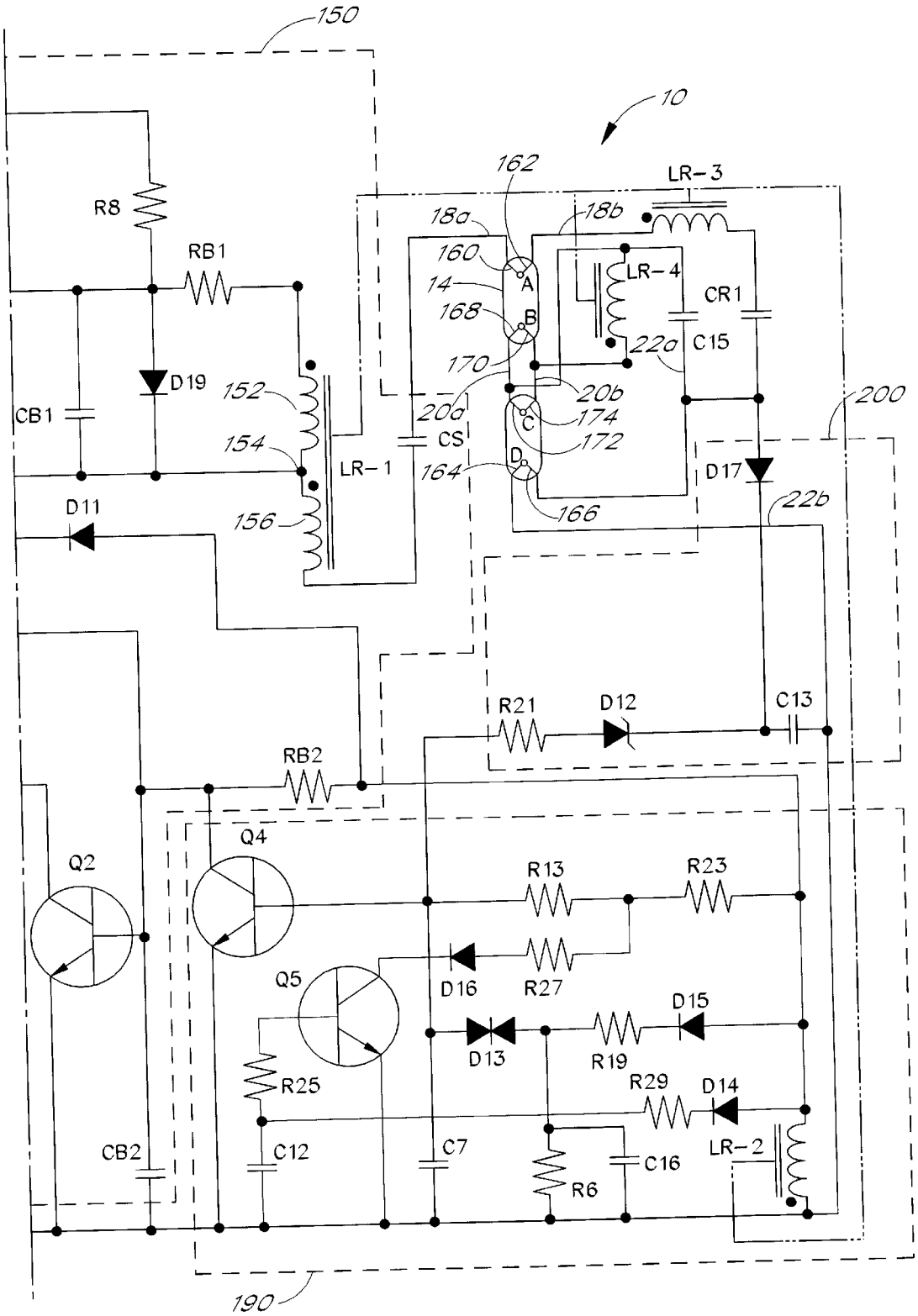

FIG. 2 illustrates the ballast circuit 10 in accordance with one aspect of the present invention. An EMI filter stage 100 comprises a high voltage input line 105, a neutral line 110, an earth ground 115, a fuse F1, capacitors C2 and C8 and inductors L1-1 and L1-2. The high voltage input line 105 is connected in series to one terminal of the fuse F1. A second terminal of the fuse F1 is connected to one terminal of the inductor L1-1. The neutral line 110 is connected to one terminal of the inductor L1-2. A second terminal of the inductor L1-2 is connected to a first terminal of the capacitor C8, a first terminal of capacitor C2, to the anode of a diode D1 and the cathode of a diode D3. A second terminal of the capacitor C8 is connected to the earth ground 115. A second terminal of the inductor L1-1 is connected to the anode of a diode D2 and to the cathode of a diode D4. In a specific circuit, the fuse F1 is advantageously formed as a fusible link on a printed circuit board (not shown). The inductors L1-1 and L1-2 are connected to the line voltages to buffer the lines and to protect the line against EMI. This prevents high frequency signals from propagating on the lines 105 and 110. In the preferred embodiment, the inductors L1-1 and L1-2 each comprise 100 turns of wire to form a 0.5 millihenry inductor. The capacitor C2 is a 0.1 microfarad capacitor rated at 630 volts.

A rectification stage 120 follows the EMI filter stage 100. The rectification stage 120 comprises the four diodes D1–D4. The four diodes D1–D4 are connected to form a full-wave bridge rectifier. The anode of the diode D1 is connected to the cathode of the diode D3, and as discussed above, to the anode of the diode D1 is also connected to one terminal of the inductor L1-2, to one terminal of C2 and to one terminal of the capacitor of C8. The cathode of the diode D1 is connected to the plus voltage rail 125. The cathode of the diode D2 is also connected to the plus voltage rail 125. The anode of the diode D2 is connected to the cathode of the diode D4 and, as discussed above, to one terminal of the inductor L1-1 and a second terminal of the capacitor C2. The anodes of the diodes D3 and D4 are both connected to a minus voltage rail 130 to provide a circuit ground. The full-wave bridge created by the diodes D1–D4 of the rectification stage 120 converts the input line voltage of the EMI filter stage 100 into DC voltage across the plus voltage rail 125 and the minus voltage rail 130. In the preferred embodiment, the diodes D1–D4 are 1N4007 diodes.

Surge protection is provided to the circuit by a diode D12. The anode of the diode D12 is connected to the plus voltage rail 125 and the cathode of the diode D12 is connected to a circuit junction 148. For example, in case of an electrical surge caused by a lightening strike, the excess energy transmitted by the lightning will be transferred from the plus voltage rail 125 through the diode D12 and will be stored in a capacitor C01. By creating this storage capacity in the capacitor C01, the sensitive circuit components are protected from the surge. In the preferred embodiment, the capacitor C01 is a 16 microfarad capacitor with a 500 volt rating.

One terminal of a filter capacitor C3 is also connected to the plus voltage rail 125. A second terminal of the filter capacitor C3 is connected to the minus voltage rail 130. The capacitor C3 provides a filtered DC voltage signal to the remainder of the circuit. In the preferred embodiment, the capacitor C3 is a 0.22 microfarad capacitor with a 630 volt rating.

A voltage control stage 135 is also connected to the plus voltage rail 125. The voltage control stage 135 comprises resistors R10 and R12, a diode D6, a capacitor C4 and an inductor L2-2. One terminal of the resistor R10 is connected to the plus voltage rail 125 and a second terminal of the resistor R10 is connected to the cathode of the diode D6, to one terminal of the capacitor C4, to an input pin 8 of a controller U1 and to the cathode of a diode D11. The anode of the diode D6 is connected to one terminal of the resistor R12 and to one terminal of the inductor L2-2. A second terminal of the resistor R12 is connected to an input pin 5 of the controller U1. A second terminal of the capacitor C4 and a second terminal of the inductor L2-2 are connected to the minus voltage rail 130.

When power is applied to the plus voltage rail 125, the capacitor C4 begins to charge via the resistor R10. When the voltage across the capacitor C4 reaches the minimum operational voltage for the controller U1, (about 10 volts in the preferred embodiment), the controller U1 begins to operate. The controller U1 outputs a control signal to the gate of a MOSFET transistor Q3 to activate the transistor Q3. When the MOSFET transistor Q3 is active, the inductor L2-2 stores energy. When the transistor Q3 is off, the inductor L2-2 dumps the stored energy through the diode D6 into the capacitor C4. Therefore, the capacitor C4 is initially charged via the resistor R10, but subsequently maintains a charge by the operation of the inductor L2-2.

The resistor R12 propagates a voltage across the inductor L2-2 to the input pin 5 of the controller U1 to enable the inductor voltage to be sensed by the controller U1. When there is no voltage across the inductor L2-2, meaning there is no change in the current flowing through the inductor L2-2, the controller U1 again activates the MOSFET transistor Q3. By ensuring there is no change in the current flowing in the inductor L2-2 before activating the MOSFET transistor Q3, the sensing via the resistor R12 and the input pin 5 prevents the continuous operation of the MOSFET transistor Q3.

In the preferred embodiment, the resistor R10 is a 102,000 ohm resistor, the resistor R12 is a 51,000 ohm resistor, the capacitor C4 is a 100 microfarad capacitor rated at 35 volts, and the inductor L2-2 comprises 11 turns of wire forming a 1.4 millihenry inductor.

A voltage divider sense-a-volt stage 140 comprises resistors R11 and R7 and a capacitor C11 to act as an input to the controller U1 to set the voltage operating range and helps improve the power factor. One terminal of the resistor R11 is connected to the plus voltage rail 125 and a second terminal of the resistor R11 is connected to a pin 3 of the controller U1 and to one terminal of a parallel combination of the resistor R7 and the capacitor C11. A second terminal of the parallel combination of the resistor R7 and the capacitor C11 is connected to the minus voltage rail 130. The signal applied to the pin 3 of the controller U1 is a divided, unfiltered signal from the rectification stage 120. This provides the controller U1 with input to the internal multiplier in the form of a haversine while the error amplifier output, pin 2 of U1, is monitored with respect to the voltage feedback input threshold. The multiplier output controls the current sense comparator threshold as the AC voltage traverses sinusoidally from zero to peak line. This has the effect of forcing the MOSFET transistor Q3 on to track the input line voltage, resulting in a fixed drive output, thus making the load appear to be resistive to the A.C. line. A significant reduction in the line current distortion is accomplished by forcing the controller U1 to switch as the AC line crosses through zero. The controller U1 operates as a critical conduction current mode controller, whereby output switch conduction is initiated by the Zero Current Detector and terminated when the peak inductor current reaches the threshold level established by the Multiplier output. The Zero Current Detector initiates the next on-time by setting the internal RS Latch at the instant the inductor L2-2 current reaches zero. This critical conduction mode of operation has two significant benefits. First, because the MOSFET transistor Q3 cannot turn on until the inductor L2-2 current reaches zero, the output rectifier reverse recovery time becomes less critical. Second, since there are no deadtime gaps between cycles, the AC line current is continuous, thus limiting the peak switch to twice the average input current and controlling the power factor.

In the preferred embodiment, the resistor R11 is a 1.3 megohm resistor, the resistor R7 is a 15,000 ohm resistor, and the capacitor C11 is a 0.01 microfarad capacitor rated at 50 volts.

The controller U1 is part of a power control stage 144. In the preferred embodiment, the controller U1 is a Motorola integrated circuit part number 34262. The 34262 is an active power factor controller designed for use as a pre-converter in electronic ballast applications. The controller features an internal start-up timer for stand alone applications, a one quadrant multiplier for near unity power factor, a zero current detector to ensure critical conduction operation, a transconductance error amplifier, a quickstart circuit for enhanced start-up, a trimmed internal bandgap reference, a current sensing comparator, and a totem pole output suited for driving a power MOSFET.

The controller U1 has eight pins numbered 1–8. The input pin 1 is a sensed voltage (VIN) input. The input pin 2 is a compensation input and pin 3 is a multiplier input. The input pin 4 is the current sense input and the input pin 5 is Zero Current Detect Input. The input pin 6 is ground. A pin 7 is the drive output pin. The input pin 8 is a power (Vcc) input. The ground input pin 6 is connected to the minus voltage rail 130 which provides the circuit ground. The compensation input pin 2 is connected to one terminal of the capacitor C10. A second terminal of the capacitor C10 is connected to the minus voltage rail 130. The capacitor C10 is thus connected in a feedback loop to provide stability for the controller U1. In the preferred embodiment, the capacitor C10 is a 0.68 microfarad capacitor rated at 50 volts. The voltage input pin 1 (VIN) is used to keep the output voltage constant.

A second voltage divider stage 142 supplies a fraction of the output voltage across the capacitor C01 to the input VIN of pin 1. The second voltage divider stage 142 comprises resistors R1, R4 and a capacitor C9. One terminal of the resistor R1 is connected to a circuit junction 148. A second terminal of the resistor R1 is connected to input pin 1 of U1, and to one terminal of the parallel combination of the resistor R4 and the capacitor C9. A second terminal of the parallel combination of the resistor R4 and the capacitor C9 is connected to the minus voltage rail 130.

The voltage across the capacitor C01, measured from the circuit junction 148 to the minus voltage rail 130, is divided through the combination of the resistors R1 and R4 and the capacitor C9 to provide a fraction of the voltage across the capacitor C01 to the input pin 1 of the controller U1. This provides a means for the controller U1 to detect the output voltage and make necessary adjustments to keep the voltage constant.

In the preferred embodiment, the resistor R1 is a 1.8 megohm resistor, the resistor R4 is a 10,000 ohm resistor, and the capacitor C9 is a 0.01 microfarad capacitor rated at 50 volts.

As discussed above, the output pin 7 of the controller U1 is connected to the gate of the MOSFET transistor Q3 to allow the controller U1 to either turn the transistor Q3 on or turn the transistor Q3 off, depending upon the signal at the output pin 7. In the preferred embodiment, the transistor Q3 is an International Rectifier MOSFET, part number 840.

The input pin 4 of the controller U1 is the current sense pin and is connected to the source terminal of the transistor Q3 and to a dynamic current sense stage 145. The dynamic current sense stage 145 comprises resistors R23, R25 and a diode D18. The input pin 4 of the controller U1 is connected to the anode of the diode D18 and to one terminal of the resistor R25. The cathode of the diode D18 is connected to one terminal of the resistor R23. A second terminal of the resistor R23 is connected to the minus voltage rail 130. A second terminal of the resistor R25 is also connected to the minus voltage rail 130. The input pin 4 of the controller U1 detects the voltage across the resistor R25. The voltage of that combination is monitored and compared to a voltage derived from the multiplier output. This result is used to set the output voltage level fed to the gate of the transistor Q3. Additionally the combination of the inputs to the multiplier at pin 3 and the current sense at pin 4 of the controller U1 achieves power factor control independent of the power transferred to the load. This is achieved by an internal algorithm within the controller U1.

The boost factor is the ratio of the output voltage across the capacitor C01 to the input voltage on the high voltage input line 105. In the preferred embodiment, the output voltage across the capacitor C01 is 460 volts. A high input voltage on the high voltage input line 105 of approximately 277 volts requires a 10% boost ratio because the maximum acceptable input voltage will be 10% above the 277 volts, or 305 volts maximum. This provides a peak input voltage of 426 volts. A 10% boost factor on the 426 volts will result in an output voltage of 469 volts which is very close to the desired 470 volts across the capacitor C01.

To accomplish this boost factor, the current flowing through the inductor L2-1 and consequently through the transistor Q3 and the resistor R25, is low. As the voltage supplied to the high voltage input line 105 is reduced, the current in the system starts to increase. The voltage across the combination of the resistors R25 and R23 is supplied to the input pin 4 of the controller U1. This voltage controls the level of the output voltage of the controller U1.

As the current increases to the point where the voltage across the resistor R25 reaches the threshold voltage of the diode D18, (about 0.6 volts in the preferred embodiment), the diode D18 will start to turn on. As the diode D18 turns on, the resistor R23 is effectively connected in parallel to the resistor R25 to decrease the total resistance. This provides a dynamic method of controlling the total resistance value of the combination of the resistors R23 and R25. Therefore, the circuit detects the higher current flowing and adjusts the output voltage of the controller U1 to the new condition without limiting power. This technique allows a wide range of input voltages to be supplied to the high voltage input line 105 and still achieve a constant DC output voltage across the capacitor C01.

In the preferred embodiment, the resistor R25 is a 1.8 ohm resistor, the resistor R23 is a 2.2 ohm resistor, and the diode D18 is a 1N4148 diode.

A power output stage 150 receives the uniform DC voltage across the capacitor C01. The voltage across the capacitor C01 is measured between the circuit junction 148 and the minus voltage rail 130. The power output stage 150 comprises transistors Q1 and Q2, diodes D7–D11 and D19, resistors R5,R8,R9,RB1 and RB2, capacitors C5,C6,CB1 and CB2 and an inductor LR-1.

The transistors Q1 and Q2 are connected as a half-bridge inverter. In the preferred embodiment, these transistors are standard Motorola BUL45 NPN transistors. The collector of the transistor Q1 receives the DC voltage from the circuit junction 148. The collector of the transistor Q1 is also connected to the cathode of the diode D7 and to one terminal of the resistor R8. The emitter of the transistor Q1 is connected to the anode of the diode D7, to one terminal of the capacitor C5, to one terminal of the capacitor CB1, to the cathodes of diodes D8, D10 and D19, to the collector of transistor Q2, and to a tap 154 between a first section 152 and a second section 156 of the inductor LR-1. The base of the transistor Q1 is connected to a second terminal of the capacitor CB1, to a second terminal of the resistor R8, to the anode of the diode D19, and to one terminal of the resistor RB1. A second terminal of the resistor RB1 is connected to a first terminal of the inductor LR-1 which is connected to the first section 152.

As discussed above, the collector of the transistor Q2 is connected to the emitter of the transistor Q1, and therefore is also connected to all of the components connected to the emitter of the transistor Q1. The emitter of the transistor Q2 is connected to the minus voltage rail 130. The base of the transistor Q2 is connected to one terminal of the diac D9, to one terminal of the capacitor CB2, to one terminal of the resistor RB2, and to the collector of the transistor Q4. A second terminal of the capacitor CB2 is connected to the minus voltage rail 130. A second terminal of the diac D9 is connected to the anode of the diode D8, to one terminal of the capacitor C6, and to one terminal of the resistor R5. A second terminal of the resistor R5 is connected to the plus voltage rail 125. A second terminal of the capacitor C6 is connected to one terminal of the resistor R9. A second terminal of the resistor R9 is connected to the minus voltage rail 130. The minus voltage rail 130 is also connected to the anode of the diode D10.

In the preferred embodiment, the diodes D7 and D10 are UF4005 diodes, the diode D8 is a 1N4007 diode, the diode D11 is a 1N414B diode, and the diac D9 is a HT-32 diac. The resistor R5 is a 220,000 ohm resistor, the resistor R8 is a 100,000 ohm resistor, the resistor R9 is a 47 ohm resistor and the resistor RB2 is a 47 ohm resistor. The capacitor C5 is a 330 picofarad capacitor rated at 2000 volts, the capacitor C6 is a 0.1 microfarad capacitor rated at 50 volts, and the capacitors CB1 and CB2 are 0.15 microfarad capacitors rated at 50 volts. The inductor LR-1 is a 2.4 millihenry split inductor, comprising 4 turns of wire on the first section 152 and 150 turns of wire on the second section 156.

The second section 156 of the inductor LR-1 is connected to one terminal of a capacitor CS. A second terminal of the capacitor CS is connected to a first filament terminal 160. The capacitor CS is a DC blocking capacitor. In the preferred embodiment, the capacitor CS is a 0.1 microfarad capacitor rated at 400 volts.

Prior to the lamp striking, the capacitor C6 is charged through the resistor R5. When the capacitor C6 reaches a preset limit, (approximately 32 volts in the preferred embodiment), it will fire the diac D9. Once fired, the diac D9 provides a path for the energy stored in the capacitor C6 to be transferred into the base of the transistor Q2. This energy turns on the transistor Q2. Before turning on the transistor Q2, the capacitor CS is charged via the resistor R8, the resistor RB1 and the second section 156 of the inductor LR-1. However, after the transistor Q2 is activated, the current through the resistors R8 and RB1 flows through the first section 152 of the inductor LR-1, through the collector of the transistor Q2 to the emitter of the transistor Q2 to the minus voltage rail 130. Also, the energy stored in the capacitor CS is now provided to the collector of the transistor Q2 through the second section 156 of the inductor LR-1. This causes the energy stored in the capacitor CS to be discharged by the transistor Q2 via the second section of the inductor LR-1. Because the capacitors CR1 and CS are connected in series with the inductor LR-1, the circuit will begin to resonate. The energy stored in the capacitors CR1 and CS is then discharged in a resonating mode via the resonating elements, the capacitor CR and the inductor LR. This creates a trapezoidal wave type of resonating signal that will alternatively drive the transistors Q1 and Q2 to maintain this oscillating (i.e., resonating) process.

Because a higher than normal voltage is applied using this resonating technique, the lamps 14 and 16 will be lit that are reaching the end-of-life state which requires a higher striking voltage. This extends the practical useful life of a fluorescent lamp. Also, the higher voltage allows the lamp to be struck at lower temperatures. The present invention will strike a lamp in weather as cold as −20° C.

The transistor Q1 will turn on when there is a positive polarity across the first section 152 of the inductor LR-1. Inductors LR-1, LR-2, LR-3 and LR-4 share the same ferromagnetic core and have mutual inductance. As indicated by the dots, the inductor LR-2, which is the driving section for the transistor Q2, is opposite in polarity from the first section 152 of the inductor LR-1. Because of the opposite polarity, the transistors Q1 and Q2 can never be on at the same time. If the transistors Q1 and Q2 were to turn on at the same time, they would create a cross conduction current which would short circuit the capacitor C01.

The circuit in FIG. 1 has connections for two fluorescent lamps. A first filament terminal 160 and a second filament terminal 162 connect a first filament A. A third filament terminal 168 and a fourth filament terminal 170 connect a second filament B. A fifth filament terminal 172 and a sixth filament terminal 174 connect a third filament C. A seventh filament terminal 164 and an eighth filament terminal 166 connect a fourth filament D.

In two-lamp operation, the first fluorescent lamp 14 is connected between the first and second filament terminals 160, 162 and the third and fourth filament terminals 168, 170. The second fluorescent lamp 16 is connected between the seventh and eighth filament terminals 164, 166 and the fifth and sixth filament terminals 172, 174.

For one-lamp operation, the first fluorescent lamp 14 is connected between the first and second filament terminals 160, 162 and the seventh and eighth filament terminals 164, 166, and the other filament terminals are not used. The second filament terminal 162, is connected to one terminal of the inductor LR-3. A second terminal of the inductor LR-3 is connected to a first terminal of the capacitor CR1. A second terminal of the capacitor CR1 is connected to the anode of the diode D17, a first terminal of capacitor C15 and, to the eighth filament terminal 166. The seventh filament terminal 164 is connected to the minus voltage rail 130.

When in two-lamp operation, the second terminal of capacitor C15, the fourth filament terminal 170 and the sixth filament terminal 174 are connected to one terminal of the inductor LR-4. A second terminal of the inductor LR-4 is connected to the third filament terminal 168 and the fifth filament terminal 172 to connect the filaments B and C in parallel. In two lamp operation, the first lamp 14, having filaments A and B, is connected in series to the second lamp 16, having filaments C and D.

This circuit configuration causes the lamp to work as a switch. Before the lamp strikes, when power is first applied to the circuit, the second section 156 of the inductor LR-1, the capacitor CS, the filament A, the inductor LR-3, the capacitor CR1 and the filament D are in series when the transistor Q1 turns on. Thus, the impedance is determined in part by the series combination of the second segment 156, the inductor LR-3 and the capacitor CR1. The cold (unstruck) lamp presents a very high impedance to the circuit. The resonant frequency of the circuit is determined by the combined series inductance of the second section 156 of inductor LR-1 and inductor LR-3.

After the lamp strikes, the impedance of the lamps goes down to a few hundred ohms. In the preferred embodiment, this impedance will be between 200 and 500 ohms. In this state, the inductor LR-1 is the new resonating inductor and the load will be connected in parallel to the inductor LR-3 and the capacitor CR1. Before striking, the resonating inductance is the series combination of the inductors LR-1 and LR-3. After striking the lamp, the struck lamp impedance effectively shunts the series combination of LR-3 and CR1. In the preferred embodiment, after the lamps strikes the series inductance is cut by approximately 40 percent. This occurs because the inductance is the square of the number of turns of wire on the inductor. Before striking, there are 150 turns of wire on the second section of the inductor LR-1 and 45 turns of wire on the inductor LR-3 for a total of 195 turns of wire. After the lamp strikes, the resonating inductor is only the 150 turn section of the inductor LR-1. The ratio between the square of 195 turns and the square of 150 turns is 1.7:1.0 and reduces the post-strike inductance to approximately 59% of the original inductance.

There are several advantages to this method of having the striking lamp switch the inductance out. First, near the end of a lamp's life, the lamp may have good filaments but not strike. This causes the impedance of the circuit to stay high. In this situation, a high inductance is desirable because a large impedance lowers the current. When the lamp strikes, a lower impedance is desired in order to efficiently transfer power. Also, prior to the lamp striking, the circuit tends to operate at a higher frequency, and the circuit is designed in a way to create a local resonance between the inductor LR-3 and the capacitor CR1. This is a series resonance, so that before the lamp strikes, the impedance of the combination of the inductor LR-3 and the capacitor CR1 is going to be lower than the capacitor CR1 only. Because of this low impedance, there is a higher current flowing into the first and second filament terminals 160, 162 and the seventh and eighth filament terminals 164 and 166. This high current is desirable prior to lamp striking in order to preheat the filaments. After the lamp strikes, the impedance of the inductor LR-3 and the capacitor CR1 together is going to be higher than the impedance of the capacitor CR1 only. This is because the frequency shifts downwards and moves away from the local resonance after the lamp strikes. This reduces the current on the filaments of the lamps and increase the overall efficiency of operations. Therefore, prior to the lamp striking, a series resonating circuit comprises the inductors LR-1 and LR-3 and the capacitor CR1 all connected in series. After the lamp strikes, the inductor LR-1 is connected in series, with the load, and the load is connected in parallel to the inductor LR-3 and the resonating capacitor CR1, creating a complex resonating circuit. However, the impedance of the lamp is sufficiently lower than the impedance of the series combination of the inductor LR-3 and the capacitor CR1 such that the series combination is effectively out of the circuit.

If there are no lamps in the circuit so that the capacitors CS and CR1 and the inductors LR-1 and LR-3 are connected in series, the diac D9 will not fire. The charge across the capacitor C6 will continue to attempt to fire the diac D9 until a lamp is inserted. Once the diac D9 is fired and the transistor Q2 turns on, any charge in the capacitor C6 will be drained via the diode D8 through the collector of the transistor Q2.

In the preferred embodiment, the inductor LR-3 comprises 45 turns of wire forming a 2.3 millihenry inductor, the inductor LR-4 comprises 2 turns of wire of the same inductor, and the capacitor CR1 is a 3.3 picofarad capacitor rated at 400 volts.

The final section of the circuit is a lamp load control stage 190. The lamp load control stage 190 includes transistors Q4 and Q5, capacitors C7, C12, and C16, an inductor LR-2, resistors R6, R13, R19, R23, R25, R27 and R29, diodes D14, D15, and D16 and a diac D13. As discussed above, the collector of the transistor Q4 is connected to one terminal of the resistor RB2, to a second terminal of the diac D9, to the base of the transistor Q2, and to one terminal of the capacitor CB2. The emitter of the transistor Q4 is connected to the minus voltage rail 130. The base of the transistor Q4 is connected to one terminal of the resistor R13, to one terminal of a resistor R21, to one terminal of the diac D13, and to one terminal of the capacitor C7. A second terminal of the capacitor C7 is connected to the minus voltage rail 130. A second terminal of the resistor R13 is connected to the first terminals of the resistors R27 and R23. The second terminal of the resistor R23 is connected to a second terminal of the resistor RB2, to the anode of the diode D14, to the anode of the diode D15, to the anode of diode D11 , and to one terminal of the inductor LR-2. A second terminal of the inductor LR-2 is connected to the minus voltage rail 130. The cathode of the diode D15 is connected to a first terminal of the resistor R19. The second terminal of the resistor R19 is connected to the second terminal of the diac D13 and to the first terminal of the parallel combination of the resistor R6 and the capacitor C16. The second terminal of the resistor R27 is connected to the anode of the diode D16. The cathode of the diode D16 is connected to the collector of the transistor Q5. The base of the transistor Q5 is connected to a first terminal of the resistor R25. The second terminal of the resistor R25 is connected to a first terminal of the capacitor C12 and to a first terminal of the resistor R29. The second terminal of the resistor R29 is connected to the cathode of the diode D14. The second terminal of the capacitor C12 is connected to the negative voltage rail 130.

In the preferred embodiment, the transistors Q4 and Q5 are 2N4401 transistors, the capacitor C7 is a 0.01 microfarad capacitor rated at 50 volts, the capacitor C7 is a 0.01 microfarad capacitor rated at 50 volts, the capacitor C12 is a 100 microfarad capacitor rated at 25 volts, and the inductor LR-2 comprises 2 turns of wire forming a 1.8 millihenry inductor. The diodes D14, D15 and D16 are 1N4148 diodes, and the diac D13 is a HS-10 diac. The resistor R6 is a 178 ohm resistor, the resistor R13 is a 1,000 ohm resistor, the resistor R19 is a 30.1 ohm resistor, the resistor R23 is a 200 ohm resistor, the resistor R25 is a 10000 ohm resistor, the resistor R27 is a 180 ohm resistor, and the resistor R29 is a 20,000 ohm resistor.

The lamp load control stage 190 controls the three phases of lamp load operation. These phases are the filament warming phase, the lamp load starting phase, and the lamp load operating phase. Certain conditions must be met when starting the lamp. The first condition is that the voltage applied to the load must be less than the break down voltage of the lamp (i.e., the voltage at which the vapor ionizes and the lamp begins to glow). The break down voltage is defined by the lamp glow current and must be less than or equal to 25 milliamperes RMS. Finally, the glow current must be supplied for at least 0.5 seconds and less than or equal to 1.5 seconds. The diodes D14, D15, and D16 assure that the lamp load control stage 190 operates only during the positive half cycle. When the ballast circuit 10 starts operation, the capacitor C12 is uncharged and therefore current is not supplied to the base of the transistor Q5 with the result that the transistor Q5 is turned off. The transistor Q5 controls a voltage divider network defined by the resistors R13, R23, and R27. As a result, the full current from the inductor LR-2 is supplied to the base of the transistor Q4 through the resistors R13 and R23 which turns on the transistor Q4 and quickly turns off the transistor Q2 thereby severely truncating the on time of the transistor Q2. This supplies a filament warming current for the specified time to the lamp load.

During the next operating phase, the transistor Q5 turns on for an interval defined by the time constant established by the resistor R29 and the capacitor C12. The transistor Q5 starts acting as a voltage divider and supplies a lower base current to the transistor Q4 thereby extending the phase angle of the transistor Q4. The increased on time of the transistor Q4 causes the high voltage supplied to the lamp load to rise due to an increase in frequency and in conjunction with the warmed filament, as previously discussed, the lamp is struck. The striking voltage will be supplied for a time defined by the resistor R19 and the capacitor C7. When the lamp is struck, the voltage across the second section 156 of the inductor LR-1 will increase as will the voltage across the magnetically coupled inductor LR-2. This will serve to maintain the charge on the capacitor C12 and ensures a continuous supply of the proper operating high frequency voltage to the lamp load, and thus prevents the circuit from chattering.

If the lamps do not strike, the voltage supplied by the inductor LR-2 will continue to climb until it reaches the breakdown voltage of the diac D13. This will charge up the capacitor C7 and turn on the transistor Q4 which will turn off the transistor Q2. The transistor Q2 will remain off for a time defined by the resistor R5 and the capacitor C6, and the entire cycle will start from the beginning until the lamp load strikes.

A further feature includes a fluorescent tube length compensator 200. Various fluorescent lamps have different filament impedances dependent upon the spacing of the opposing filaments. The tube length compensator 200 includes a diode D17, a resistor R21, a zener diode D12 and a capacitor C13. The diode D17 passes the positive half wave and charges the capacitor C13. When the voltage across the capacitor C13 exceeds the reference voltage of the zener diode D12 by 0.7 volts, the transistor Q4 begins to turn on and adjusts the phase angle of the transistor Q2. The delay in turning the transistor Q4 on increases the striking voltage for lamps with a higher filament impedance.

The cathode of the diode D17 is connected to the first terminal of the capacitor C13 and the cathode of the zener diode D12. The anode of the zener diode D12 is connected to one terminal of the resistor R21 and the second terminal of the resistor R21 is connected to the base of the transistor Q4. The second terminal of the capacitor C13 is connected to the negative voltage rail 130.

In the preferred embodiment, the diode D17 is a 1N4148 zener diode, the diode D12 is a 1N5231B diode, the resistor R21 has a resistance of 36,000 ohms, and the capacitor C13 has a capacitance of 0.1 microfarad at 50 volts.

Numerous variations and modifications of the invention will become readily apparent to those skilled in the art. Accordingly, the invention may be embodied in other specific forms without departing from its spirit or essential characteristics. The detailed embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. A fluorescent lamp ballast responsive to a varying AC voltage input signal and capable of boosting its DC output voltage of a DC voltage amplification and conditioning stage as a function of said varying AC voltage input signal, said fluorescent lamp ballast comprising:

an AC voltage input stage;

a voltage rectification stage;

said DC voltage amplification and conditioning stage;

a series resonant load driving stage;

said DC voltage amplification and conditioning stage having a dynamic current sense stage wherein said dynamic current sense stage is an input to a power factor control means;

said input to the power factor control means causing a DC output of said power factor control means to increase responsive to said dynamic current sense stage;

said dynamic current sense stage having a first terminal of a current sense resistor being connected to an anode of a level sensitive diode, wherein the cathode of said level sensitive diode is connected to a first terminal of a voltage boosting resistor, the second terminal of said voltage boosting resistor being connected to the second terminal of the current sense resistor and a negative rail of the fluorescent lamp ballast; and said first terminal of said current sense resistor being connected to a current sense input to said power factor control means.

2. The ballast of claim 1, wherein said load stage comprises:

a first input terminal and a second input terminal which receive an input voltage;

a first inductance having a first terminal and a second terminal, wherein the first terminal of said first inductance is coupled to said first input terminal;

a second inductance having a first terminal and a second terminal, wherein said first terminal of said second inductance is coupled to said second terminal of said first inductance, wherein one or more lamps are connected between said first terminal of said second inductance and said second input terminal; and a capacitance coupled between said second terminal of said second inductance and said second input terminal.

3. The ballast of claim 2, further comprising:

a lamp load control stage which converts an amplified DC voltage to a high frequency AC signal suitable for striking and operating a lamp load;

said lamp load control stage supplying a lamp filament warming current to said lamp load;

said lamp load control stage upon supplying said lamp filament warming current to said lamp load controllingly increases a phase angle of a transistor which applies power to said lamp load; and said increased phase angle raising the frequency of the AC signal applied to the lamp load thereby applying a high frequency high voltage lamp load striking signal as a sequence of bursts through said series resonant load driving stage; and a lamp load stage which receives said sequence of bursts to begin a striking cycle to strike one or more of said lamps;

said lamp load control stage reducing said high frequency high voltage lamp load striking signal to a lower level high voltage lamp load operating signal upon ignition of said lamp load stage; and said lamp load control stage upwardly adjusting said high frequency high voltage lamp load striking signal based upon a failure of said lamp load stage to strike;

said lamp load control stage disabling operation of said fluorescent lamp ballast for a quiescent time and then repeating the striking cycle until lamp load stage ignition occurs;

said striking cycle being a protection mode against a missing lamp load; and said striking cycle being a protection mode against a failed lamp load stage filament.

4. The ballast of claim 3, wherein said sequence of bursts applies a high voltage across said lamps, thereby striking lamps near an end-of-life state.

5. The ballast of claim 3, wherein said sequence of bursts applies a high voltage across said lamps, thereby striking lamps in cold weather.

6. A circuit which converts a wide range of line voltages to a constant output voltage to drive a gas discharge lamp load, the circuit comprising:

a filtering stage which receives said line voltage and generates a filtered input voltage;

a rectification stage which receives said filtered input voltage and converts said filtered input voltage to a DC voltage;

a power control stage, which generates said constant output voltage;

a voltage control stage which receives said DC voltage and provides a control voltage to said power control stage, wherein said power control stage is responsive to said control voltage;

a voltage divider which receives said constant output voltage and delivers a portion of said constant output voltage as a reference voltage to said power control stage, said power control stage responsive to said reference voltage to maintain said constant output voltage; and a dynamic current sense stage having a resistance value, wherein the dynamic current sense stage varies the resistance value to regulate said power control stage without limiting power, wherein said dynamic current sense stage is responsive to said voltage.

7. The circuit of claim 6, wherein the dynamic current sense stage comprises:

a first resistance having a first terminal and a second terminal;

a diode having an anode and a cathode, wherein said anode of said diode is coupled to said first terminal of said first resistance; and a second resistance having a first terminal and a second terminal, wherein said cathode of said diode is coupled to said first terminal of said second resistance and said second terminal of said second resistance is coupled to said second terminal of said first resistance, and wherein at a predetermined level the diode connects the first resistance in parallel with the second resistance to lower the overall impedance.

8. The circuit of claim 6, wherein the power control stage comprises:

a switching transistor having an on state and an off state, wherein said switching transistor regulates the frequency of operation of the circuit;

a controller which provides a drive signal to the switching transistor, said drive signal changing the state of said switching transistor;

a capacitance which stores said constant output voltage; and an inductance which stores energy when said switching transistor is in said on state and which transfers energy to said capacitance when said switching transistor is in said off state.

9. The circuit of claim 8, wherein the frequency of operation modifies the constant output voltage.

10. The circuit of claim 8, wherein the controller is a power factor controller.

11. A circuit which converts a wide range of line voltages to a constant output voltage to drive a gas discharge lamp load, the circuit comprising:

a power control stage which generates said constant output voltage; and a dynamic current sense stage regulating said power control stage, wherein said dynamic current sense stage is responsive to said line voltage, wherein the dynamic current sense stage comprises:

a first resistance having a first terminal and a second terminal;

a diode having an anode and a cathode, wherein said anode of said diode is coupled to said first terminal of said first resistance; and a second resistance having a first terminal and a second terminal, wherein said cathode of said diode is coupled to said first terminal of said second resistance and said second terminal of said second resistance is coupled to said second terminal of said first resistance, and wherein at a predetermined level the diode connects the first resistance in parallel with the second resistance to lower the overall impedance.

* * * * *

UNITED STATES PATENT AND TRADEMARK OFFICE

CERTIFICATE OF CORRECTION

PATENT NO. : 5,925,986
DATED : July 20, 1999
INVENTOR(S) : Mihail Moisin

It is certified that error appears in the above-identified patent and that said Letters Patent is hereby corrected as shown below:

Column 13,
Line 53, change "said voltage" to -- said range of line voltages --.

Signed and Sealed this

Twenty-ninth Day of January, 2002

*Attest:*

*Attesting Officer*

JAMES E. ROGAN
*Director of the United States Patent and Trademark Office*